US009777688B2

(12) United States Patent
Rehwald et al.

(10) Patent No.: US 9,777,688 B2
(45) Date of Patent: Oct. 3, 2017

(54) HOLDER FOR FASTENING A COMPONENT ON AN INTERNAL COMBUSTION ENGINE, A BEARING SLEEVE FOR SUCH A HOLDER, AND A FUEL INJECTION SYSTEM

(71) Applicant: ROBERT BOSCH GMBH, Stuttgart (DE)

(72) Inventors: Andreas Rehwald, Bietigheim-Bissingen (DE); Matthias Maess, Boeblingen (DE); Goekhan Guengoer, Eberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 250 days.

(21) Appl. No.: 14/390,643

(22) PCT Filed: Mar. 27, 2013

(86) PCT No.: PCT/EP2013/056561

§ 371 (c)(1),
(2) Date: Oct. 3, 2014

(87) PCT Pub. No.: WO2013/149914

PCT Pub. Date: Oct. 10, 2013

(65) Prior Publication Data

US 2015/0136085 A1 May 21, 2015

(30) Foreign Application Priority Data

Apr. 4, 2012 (DE) ..... 10 2012 205 580

(51) Int. Cl.
*F02M 61/14* (2006.01)
*F02M 55/04* (2006.01)
(Continued)

(52) U.S. Cl.
CPC ..... *F02M 61/14* (2013.01); *F02M 55/02* (2013.01); *F02M 55/025* (2013.01);
(Continued)

(58) Field of Classification Search
CPC ..... F02M 61/14; F02M 55/02; F02M 55/04; F02M 69/465; F02M 55/025;
(Continued)

(56) References Cited

U.S. PATENT DOCUMENTS 3,695,386 A * 10/1972 Thien ..... G10K 11/16 123/195 C
3,756,551 A * 9/1973 Bishop ..... F16F 1/3732 267/141.1

(Continued)

FOREIGN PATENT DOCUMENTS

DE 196 28 651 1/1997

*Primary Examiner* — Grant Moubry
(74) *Attorney, Agent, or Firm* — Norton Rose Fulbright US LLP; Gerard Messina

(57) ABSTRACT

A bearing sleeve for a holder, which is used for fastening a fuel distributor on an add-on structure, includes a first sleeve part and a second sleeve part. The first sleeve part has a rigid sleeve body and a damping element which is integrally connected to the sleeve body of the first sleeve part. The second sleeve part has a rigid sleeve body and a damping element which is integrally connected to the sleeve body of the second sleeve part.

22 Claims, 3 Drawing Sheets

(51) Int. Cl.
*F02M 55/02* (2006.01)
*F02M 69/46* (2006.01)

(52) U.S. Cl.
CPC ..... *F02M 55/04* (2013.01); *F02M 69/465* (2013.01); *F02M 2200/85* (2013.01); *F02M 2200/857* (2013.01); *F02M 2200/9015* (2013.01)

(58) Field of Classification Search
CPC ..... F02M 2200/85; F02M 2200/9015; F02M 2200/857; F02M 2200/31; F02M 2200/315; F02M 37/0041; F16F 1/41; F16F 1/374; F16F 1/373
USPC ..... 123/456, 469, 470
See application file for complete search history.

(56) References Cited

U.S. PATENT DOCUMENTS 4,286,777 A * 9/1981 Brown ..... B60G 99/004 248/635
4,391,436 A 7/1983 Fishbaugh
4,530,491 A * 7/1985 Bucksbee ..... F16F 1/3732 267/141
4,852,533 A * 8/1989 Doncker ..... F16F 13/06 123/190.17
4,863,329 A * 9/1989 Wilson ..... F16B 5/02 248/635
5,044,338 A * 9/1991 Shelton ..... F02M 69/465 123/456
5,080,335 A * 1/1992 Solleder ..... F16F 1/3732 267/141.1
5,141,203 A * 8/1992 Baker ..... B63H 21/305 248/635
5,257,768 A * 11/1993 Juenemann ..... F16L 55/035 248/604
5,743,509 A * 4/1998 Kanda ..... F16F 1/38 248/634
5,842,677 A * 12/1998 Sweeney ..... F16F 1/3863 248/56
6,869,034 B2 * 3/2005 Glaser ..... F02M 51/0685 239/585.1
7,185,873 B2 * 3/2007 Suka ..... F16F 1/3732 248/635
7,591,246 B2 * 9/2009 Beardmore ..... F02M 55/025 123/456
7,682,117 B2 3/2010 Holt et al.
2008/0079205 A1 4/2008 Hayashi et al.
2013/0104852 A1 * 5/2013 Kannan ..... F02M 61/168 123/456

* cited by examiner

HOLDER FOR FASTENING A COMPONENT ON AN INTERNAL COMBUSTION ENGINE, A BEARING SLEEVE FOR SUCH A HOLDER, AND A FUEL INJECTION SYSTEM

FIELD OF THE INVENTION

The present invention relates to a holder for fastening at least one component, especially a fuel distributor, on an internal combustion engine. The present invention specifically relates to the field of fuel injection systems for internal combustion engines.

BACKGROUND INFORMATION

U.S. Pat. No. 7,682,117 B2 discusses an isolating holder for connecting a fuel distributor rail of a fuel injection system for the direct injection of fuel into an internal combustion engine, in order to reduce the transmission of noise and structure-borne noise from the fuel distributor rail to the engine structure, by realizing an elastic decoupling. The advantage is a reduction in the audible noise of the fuel distributor rail. Clamping elements are provided, which face each other, serve as pretension delimiters and have a damping ring made of an elastomer assigned in each case. In the fastening, the axial pretensioning excursion is delimited via a gap between the clamping elements.

In the holder from U.S. Pat. No. 7,682,117 B2, it is therefore possible to use two annular elastomeric components in conjunction with two metal sleeves for the damping, while the pretension is restricted. The restriction is adjustable via the predefined gap. The gap is bridged in the screw fitting, and the annular elastomeric components are pretensioned. As soon as the metal sleeves reach a hard stop, the additional screw pretension is no longer introduced into the elastomeric components but rather into the metal components. This protects the elastomeric components against overexpansion and against failure when the tightening torques are too high.

However, the holder from U.S. Pat. No. 7,682,177 B2 has the disadvantage that due to the tolerances of the individual components of the elastomer components and the metal sleeves, especially with regard to the height dimensions, tolerance-related variances in the prestretching come about in the elastomer components in the assembled state. In particular when the elastomer components are implemented as thin-layer elastomer components, they are very sensitive with regard to this tolerance chain, which causes the dimensional play to be lost. For the maximum boundary samples pretensioned the most for tolerance-related reasons are especially at risk of tearing, whereas the corresponding minimum boundary samples result in a clamping force that is too low with respect to a holder body. On the other hand, the use of elastomer components having random flexibility is also disadvantageous because this results in higher, quasi-statistical displacements of the fuel distributor and the fuel injectors with regard to the introduction of operating forces, which in turn leads to higher wear at the seals, especially at the seals with respect to a fuel injector. In addition, there is the disadvantage that a tangential movement of the elastomer material toward the rigid metal surface occurs at the boundary layers between the elastomer components and the metal sleeves. This results in heavy abrasion of the elastomer at the contact surfaces, and thus to a high risk of failure.

SUMMARY OF THE INVENTION

The bearing sleeve according to the invention having the features described herein, the holder according to the invention having the features described herein, and the fuel injection system according to the invention having the features described herein have the advantage of ensuring better vibration damping across the service life and thus robust damping of noise as well. Especially the outlined disadvantages of the related are avoidable. A tolerance-related variance in the prestretching of the damping elements is advantageously able to be reduced.

The measures mentioned in the dependent claims permit advantageous further configurations of the bearing sleeve described herein, the holder described herein, and the fuel-injection system described herein.

One advantageous area of use is for mixture-compressing internal combustion engines having externally supplied ignition. The direct gasoline injection, in particular, represents what may be a preferred area of use. The fuel distributor may be implemented as a fuel distributor rail in this context. The fuel distributor serves as shared fuel reservoir for multiple high-pressure fuel injectors. While in operation, the fuel injectors, which are connected to the fuel distributor in a suitable manner, inject the fuel required for the combustion process into the combustion chambers of the internal combustion engine under high pressure. For this purpose, the fuel is first compressed by a high-pressure pump and conveyed in controlled quantities into the fuel distributor via a high-pressure line. This basically entails the problem that the fuel distributor may be incited to vibrations in the audible frequency range. Above all, this may happen because of noise sources in the fuel injectors that are part of the fuel injection system. The structure-borne noise, for example, spreads from the fuel injectors via rail cups, the fuel distributor and the holder to the add-on structure, from where interfering noise is radiated. Such interfering noise could even reach the interior of the vehicle. The add-on structure generally is the cylinder head of the internal combustion engine. However, a linkage of the fuel distributor via spacer sleeves or via additional connection elements is possible as well. The generation of vibrations in the audible frequency range is advantageously able to be avoided or at least reduced by the bearing sleeve according to the present invention. A reliable reduction of the structure-borne noise transmission can be ensured across the service life. In particular noise that penetrates the interior of the vehicle is avoidable in this way.

In an advantageous manner, the bearing sleeve may be put together from precisely two sleeve parts during the assembly, i.e., the first sleeve part and the second sleeve part. The rigid sleeve body and the damping element of the particular sleeve part therefore constitute an integral sleeve part for the assembly, which simplifies the assembly. In addition, a defined position of the damping element in relation to the rigid sleeve body is predefined by the model type. This prevents assembly errors from the outset. In addition, because of the integrally formed connection, slipping of the damping element or ejection of the damping element under pressure relative to the rigid sleeve body is prevented during the operation as well. This makes it possible to prevent abrasion of the material of the damping element, which reduces the failure risk of the bearing sleeve.

It is advantageous that the damping element of the first sleeve part is connected to the rigid sleeve body of the first sleeve part by vulcanization. Correspondingly, it is advantageous that the damping element of the second sleeve part is connected to the rigid sleeve body of the second sleeve part by vulcanization. In this way a reliable integral connection is able to be configured between the damping element and the rigid sleeve body of the individual sleeve part. The individual damping element may be an applied vulcanized elastomer layer, in particular. This makes it possible to realize even more complex contours of the damping element with the aid of the elastomer partitioning, which is impossible in the case of a separate damping component.

It is advantageous that the rigid sleeve body of the first sleeve part is at least essentially made from a metallic material. It is furthermore advantageous that the rigid sleeve body of the second sleeve part is at least essentially made from a metallic material. Thus, it is possible to use metallic sleeve bodies for the absorption of possibly high mechanical fastening forces. The rigid sleeve bodies simultaneously restrict the pretensioning of the damping elements during the fastening. In addition, it is advantageous that the damping element of the first sleeve part is made of rubber and/or that the damping element of the second sleeve part is made of rubber. The term rubber should be interpreted generally. In particular, natural rubber or a synthetic rubber material may be used as rubber. In this way the sleeve parts may be configured as rubber-metal sleeve parts. The metallic sleeve bodies act as delimiters of the pretensioning travel or as delimiters for the pretensioning.

The sleeve parts combine the functions of screw force absorption, form-fitting support of a holder body used for fastening the fuel distributor between the two damping elements of the sleeve parts, and of vibration isolation. The sleeve parts can be produced by vulcanizing elastomeric layers onto the metallic sleeve bodies. A manner that is suitable for the curing process of the elastomer may be chosen for this purpose. In this way the elastomer partition adheres securely to the metallic sleeve bodies, so that the contact surfaces exhibits especially high wear resistance. This makes it possible to prevent shear-off of the elastically deformable damping element, as it may occur in a separate damping component due to tangential relative movements. The failure risk is therefore reduced.

An isolating effect in terms of vibrations may be ensured in all spatial directions. This applies in particular to a radial direction relative to a longitudinal axis of the bearing sleeve, in which the holder body is loaded. The sleeve bodies may be configured in such a way that at least one part of the individual damping element comes to act also between the holder body and the two rigid sleeve bodies of the sleeve parts. This avoids direct contact, in particular metallic contact, between the holder body and the rigid sleeve bodies of the sleeve parts. Because of the adherence of the damping elements to the rigid sleeve bodies, the surface of the damping elements, which is in contact with the holder body in the assembled state, is able to be profiled in a suitable manner.

It is also advantageous that the rigid sleeve body of the first sleeve part has a disk-shaped section that is oriented perpendicularly to the longitudinal axis, and a sleeve-shaped section that extends along the longitudinal axis. In a corresponding manner, it is also advantageous that the rigid sleeve body of the second sleeve part has a disk-shaped section that is oriented perpendicularly to the longitudinal axis, and a sleeve-shaped section that extends along the longitudinal axis. A gap between the rigid sleeve bodies, via which pretensioning of the damping elements takes place is able to be specified by the length of the sleeve-shaped section. Toward this end, the defined configuration of the damping element is already specifiable, so that related tolerances are reduced.

Another advantage here is also that the damping element of the first sleeve part is regionally connected to the disk-shaped section of the rigid sleeve body of the first sleeve part, and that it is regionally connected to the sleeve-shaped section of the rigid sleeve body of the first sleeve part. In a corresponding manner, it is also advantageous that the damping element of the second sleeve part is regionally connected to the disk-shaped section of the rigid sleeve body of the second sleeve part, and that it is regionally connected to the sleeve-shaped section of the rigid sleeve body of the second sleeve part. In particular precisely one damping element may in each case extend both across the disk-shaped section and across the sleeve-shaped section of the rigid sleeve body of the first sleeve part or the second sleeve part. The damping element is also able to be produced in an especially uncomplicated manner in this configuration. More specifically, the rigid sleeve body may be placed in a suitable mold, in which case a gap results in the region of the damping element to be produced. This gap can then be filled with the material for the damping element. This results in a relatively low overall tolerance and low production complexity.

However, it is also advantageous that the damping element of the first sleeve part is connected to the disk-shaped section of the rigid sleeve body of the first sleeve part, and that the first sleeve part has at least one second damping element, which is connected to the sleeve-shaped section of the rigid sleeve body of the first sleeve part. Correspondingly, it is advantageous that the damping element of the second sleeve part is connected to the disk-shaped section of the rigid sleeve body of the second sleeve part, and that the second sleeve part has at least one second damping element which is connected to the sleeve-shaped section of the rigid sleeve body of the second sleeve part. This makes it possible to selectively produce a free space for the damping elements, in which the damping elements are able to expand in the pretensioning or in the operation-related elastic deformation in order to dampen vibrations. This enables a mechanical decoupling between two or also more damping elements that are integrally connected to the rigid sleeve body of the particular sleeve part.

Accordingly, in a further potential configuration, at least one further damping element of the first sleeve part may advantageously be connected to the disk-shaped section of the rigid sleeve body of the first sleeve part. In addition or as an alternative, at least one further damping element of the first sleeve part may advantageously be connected to the sleeve-shaped section of the rigid sleeve body of the first sleeve part. This makes it possible to achieve a subdivision into multiple damping elements at the disk-shaped section or the sleeve-shaped section. Because of the free space that is available, an elastic deformability of the damping elements is able to be improved. Spring travel, in particular, can be increased in this way.

It is also advantageous that depressions are formed on at least one damping element. Such depressions, for one, can enhance an elastic deformability of the damping element. For another, such depressions also make it possible to achieve a certain profile in order to improve the load-bearing capacity of the connection in relation to the holder body which is clamped between the damping elements.

Depending on the configuration of the bearing sleeve, it is also advantageous that the rigid sleeve body of the first sleeve part and the rigid sleeve body of the second sleeve part are configured as components in common. A particular advantage here is that the first sleeve part and the second sleeve part are configured as components in common. This simplifies the production and the assembly of the bearing sleeve.

As an alternative, it is also advantageous that the rigid sleeve body of the second sleeve part is configured as a disk-shaped rigid sleeve body provided with a central opening. The restriction of the pretension may be predefined by a specified gap between the sleeve-shaped section of the rigid sleeve body of the first sleeve part and the disk-shaped rigid sleeve body of the second sleeve part.

Essential advantages therefore result depending on the configuration.

The transmission of structure-borne noise from the component, especially the fuel distributor, to the add-on structure, especially a cylinder head of the internal combustion engine, is reduced in comparison with a rigid screw connection.

Furthermore, the vibrations of the fuel distributor are damped to a greater degree, so that the sound emission from the surface of the fuel distributor decreases.

The vibration stress of the fuel distributor and of the fuel injectors, in particular high pressure fuel injectors, as a result of the vibration stressing of the internal combustion engine is reduced, since the transmission of vibrations is damped in this direction as well. This creates advantages with regard to the configuration and the reliability of these components.

The damping elements, which may in particular be configured as damping layers, adhere to what may be metallic sleeve parts in an especially satisfactory manner because of the vulcanization process. Tangential relative movements at the contact surface between the damping elements and what may be the metallic holder body are avoided in this way. The risk of tears forming at this contact surface and the abrasion risk thus is reduced as well, so that a component failure is avoided.

In addition, compared to a configuration featuring separate damping components, the number of components of the bearing sleeve is able to be reduced considerably.

Moreover, the component tolerance that is relevant in the axial direction and essential for the clamping force can be improved since only two sleeve parts are required for the basic function, which are connected to the add-on structure via a suitable fastening arrangement. In the case of separate damping components, on the other hand, the overall tolerance for the pretensioning travel results from the two tolerance widths for the metal sleeves and the two tolerance widths for the damping components. Thus, it is advantageously possible to reduce the overall tolerance to the two tolerance widths of the damping elements, since for the production of the sleeve parts, the material for the damping elements is able to be introduced in a mold in which the rigid sleeve bodies have been placed. The component tolerance of the rigid sleeve body is thereby eliminated. All in all, the greatest possible loading that may act on the damping element in the worst case scenario in view of travel-related component tolerances is improved in this way.

In addition, the form of the insulating damping elements, which are configured as damping layer, may take any shape within the limits set by production technology. Surface contours such as grooves or slots can be configured in an uncomplicated manner in an effort to increase the flexibility in the radial direction, in particular, and to thereby achieve an optimized isolating effect for a noise reduction.

Exemplary embodiments of the present invention are explained in greater detail in the following description with reference to the attached drawing, in which corresponding elements have been provided with matching reference numerals.

DETAILED DESCRIPTION

Figure 1:
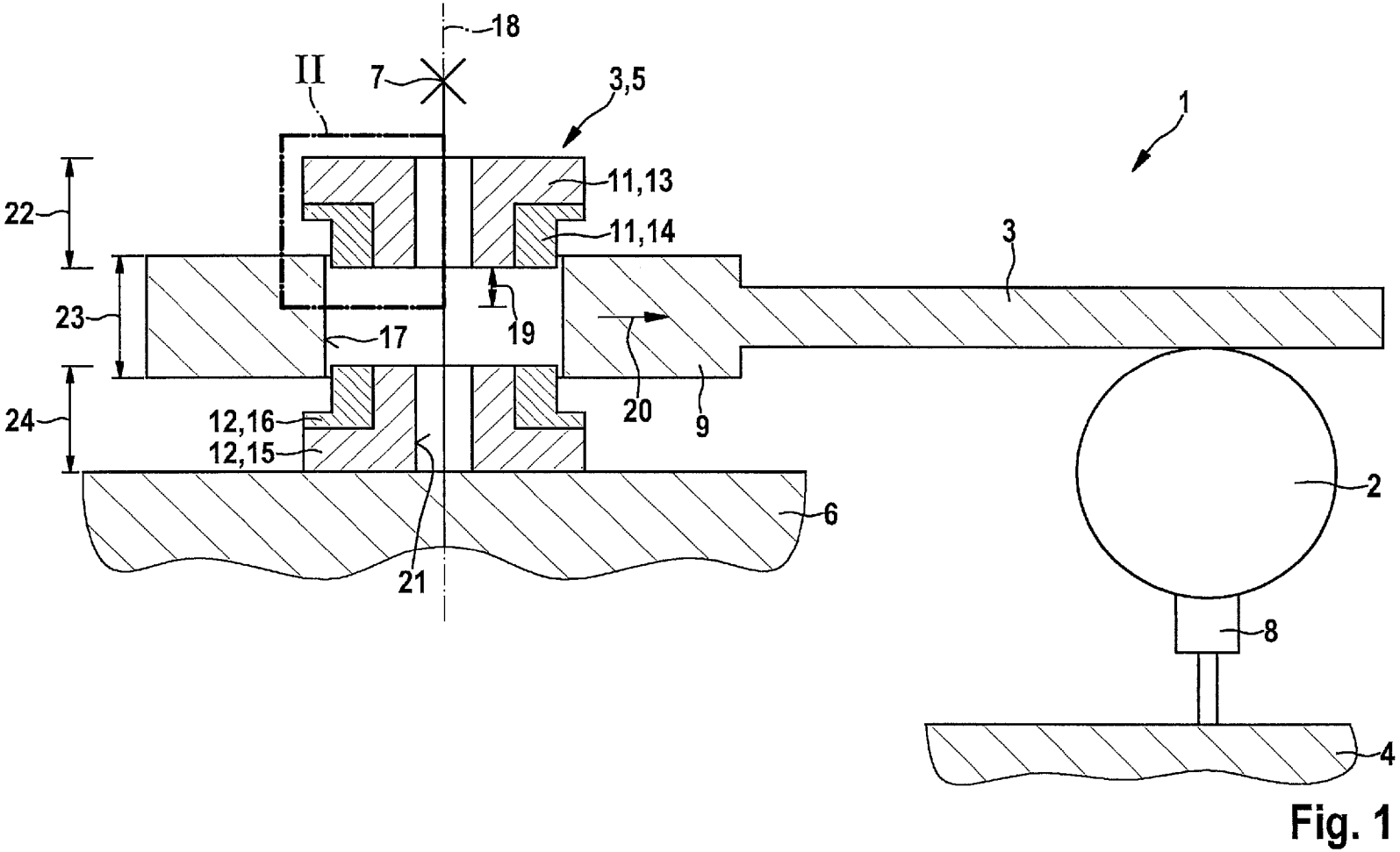
FIG. 1 shows a fuel injection system having a fuel distributor and a holder, which is used to fasten the fuel distributor on an internal combustion engine, in a cutaway, schematic sectional representation corresponding to a first exemplary embodiment of the present invention.

FIG. 1 shows a fuel injection system 1 having a fuel distributor 2 and a holder 3, which is used to fasten fuel distributor 2 on an internal combustion engine 4, in a cutaway, schematic sectional representation according to a first exemplary embodiment. Holder 3 has a bearing sleeve 5.

Fuel injection system 1 is particularly suitable for mixture-compressing internal combustion engines 4 having externally supplied ignition. In this exemplary embodiment, holder 3 is fixed in place on an add-on structure 6 via its bearing sleeve 5. The fastening uses a suitable fastening arrangement 7, in particular a screw 7. A cylinder head 6 of internal combustion engine 4, in particular, may be used as add-on structure 6. In this exemplary embodiment, a row of fuel injectors 8 is furthermore fixated together with fuel distributor 2 on internal combustion engine 4.

Holder 3 has a holder body 9. Bearing sleeve 5 has a first sleeve part 11 and a second sleeve part 12.

In this particular exemplary embodiment, first sleeve part 11 forms an upper sleeve part 11 of bearing sleeve 5, while second sleeve part 12 forms a lower sleeve part 12 of bearing sleeve 5. Upper sleeve part 11 is disposed at a distance from add-on structure 6, while lower sleeve part 12 is situated on add-on structure 6. Holder body 9 is fixated between sleeve parts 11, 12 during the assembly. Depending on the configuration of holder 3, in particular bearing sleeve 5, the lower sleeve part may also be formed by first sleeve part 11, while the upper sleeve part is formed by second sleeve part 12.

First sleeve part 11 has a rigid sleeve body 13 and a damping element 14 which is integrally connected to sleeve body 13. Rigid sleeve body 13 of first sleeve part 11 is made from a metallic material. Damping element 14 of first sleeve part 11 is made of rubber, especially natural rubber or a synthetic rubber material. Damping element 14 may be connected to rigid sleeve body 13 by vulcanization. Damping element 14 is configured as elastically deformable damping element 14.

Second sleeve part 12 has a rigid sleeve body 15 and a damping element 16, which is integrally connected to sleeve body 15. Damping element 16 of second sleeve part 12 is connected to rigid sleeve body 15 of second sleeve part 12 by vulcanization. Rigid sleeve body 15 of second sleeve part 12 is made from a metallic material. The metallic material of sleeve body 15 of second sleeve part 22 may be the same metallic material that is used for rigid sleeve body 13 of first sleeve part 11, but it is also possible to use different metallic materials. Furthermore, damping element 16 may be made from rubber, especially natural rubber, or a synthetic rubber material. Damping elements 14, 16 may be produced from the same material or also from other materials.

Holder body 9 has an opening 17, which is configured as through-hole 17. Sleeve parts 11, 12 are inserted into through-hole 17 from different sides along a longitudinal axis 18. Fastening screw 7 is screwed into add-on structure 6 for the assembly. If damping elements 14, 16 of sleeve parts 11, 12 during the assembly come to rest against holder body 9 without pretension as yet, then a gap 19 remains along longitudinal axis 18 between sleeve parts 11, 12. This gap 19 is utilized for the pretensioning of damping elements 14, 16. For fastening screw 7 is screwed into add-on structure 6 up to the point where rigid sleeve bodies 13, 15 of sleeve parts 11, 12 come to a hard stop. A further tightening torque produces a fastening force that will then be absorbed by rigid sleeve bodies 13, 15 of sleeve parts 11, 12 of bearing sleeve 5, and no further loading of damping elements 14, 16 will occur. The pretensioning of damping elements 14, 16 thus is defined solely by predefined gap 19. That means that the pretensioning of damping elements 14, 16 is independent of the tightening torque of fastening screw 7. For construction-related reasons, the resulting tolerances are also so low that the pretension of damping elements 14, 16 is able to be predefined relatively precisely via gap 19. As a result, overloading of damping elements 14, 16 on the one hand, and insufficient pretensioning of damping elements 14, 16 on the other are avoided. This not only prevents overloading of damping elements 14, 16, but also obtains sufficient holding force with respect to holder body 9 in at least a radial direction 20 which is oriented perpendicularly to longitudinal axis 18.

In the assembled state, damping elements 14, 16 of sleeve parts 11, 12 of bearing sleeve 5 ensure both a radial and an axial isolation of the vibrations in order to spatially optimize the isolating effect. Direct contacts between holder body 9 and rigid sleeve bodies 13, 15 of sleeve parts 11, 12 are hereby prevented. In particular metal-to-metal contacts are prevented.

Potential configurations of first sleeve part 11 of bearing sleeve 5 are described in greater detail in the following text with reference to FIG. 2 through 5. Second sleeve part 12 may be configured in a manner that corresponds to first sleeve part 11. However, the configuration of second sleeve part 12 may also differ from that of first sleeve part 11. In particular, rigid sleeve body 15 of second sleeve part 12 may be configured as disk-shaped rigid sleeve body 15 having an at least approximately central opening 21. Opening 21 is used for the insertion of fastening arrangement 7.

Figure 2:
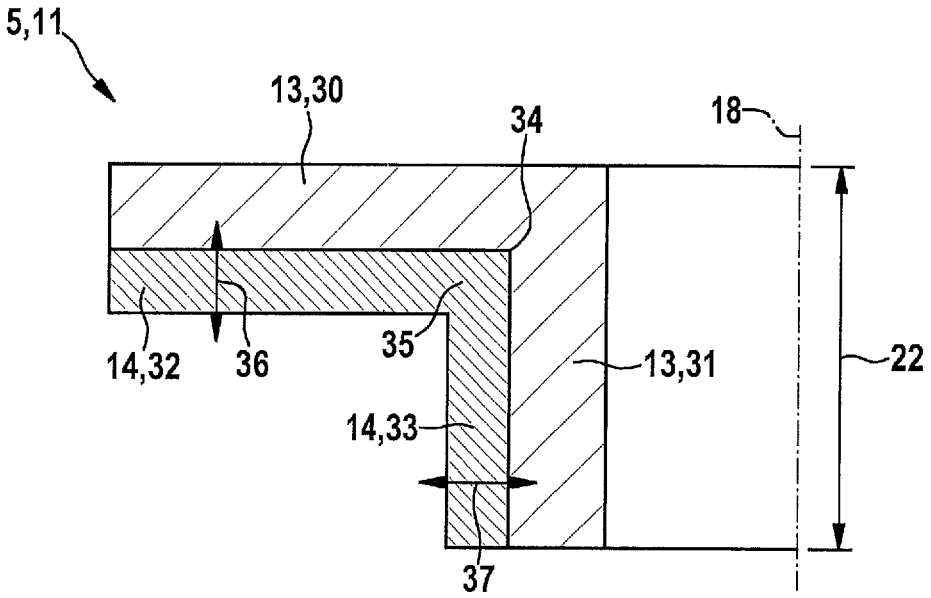
FIG. 2 shows the detail, denoted by II in FIG. 1, of a sleeve part of the bearing sleeve of the holder, in a schematic sectional view corresponding to the first exemplary embodiment of the present invention.

FIG. 2 shows the detail, denoted by II in FIG. 1, of first sleeve part 11 of bearing sleeve 5 of holder 3 in a schematic sectional view according to the first exemplary embodiment. Rigid sleeve body 13 has an axial extension 22. Axial extension 22 of rigid sleeve body 13 is simultaneously axial extension 22 of first sleeve part 11. Gap 19 is adjusted via the length of axial extension 22. Axial extension 22 of first sleeve part 11 and an axial extension 24 of second sleeve part 12 are used for bridging a thickness 23 of holder body 9 and for specifying axial gap 19. In order to bridge thickness 23 of holder body 9, axial extension 22 of first sleeve part 11 may also be selected larger if axial extension 24 of second sleeve part 12 is selected correspondingly shorter, and vice versa. Thickness 23 of holder body 9 as well as gap 19 may be distributed between first sleeve part 11 and second sleeve part 12, so to speak. In borderline cases, given a correspondingly small axial extension 24 of second sleeve part 12, second sleeve part 12 turns into a disk-shaped sleeve part 12. Damping element 16 will then be configured as disk-shaped damping element 16 and disposed on disk-shaped sleeve body 15. In this case, damping element 16 will now be acting only in the axial direction.

Rigid sleeve body 13 of first sleeve part 11 has a disk-shaped section 30 and a sleeve-shaped section 31. Disk-shaped section 30 is oriented perpendicularly to longitudinal axis 18. Sleeve-shaped section 31 extends along longitudinal axis 18. In this exemplary embodiment, damping element 14 has a disk-shaped section 32 and a sleeve-shaped section 33. Disk-shaped section 32 is oriented perpendicularly to longitudinal axis 18. Sleeve-shaped section 33 of damping element 14 extends along longitudinal axis 18. In this exemplary embodiment, damping element 14 is therefore regionally connected to disk-shaped section 30 of rigid sleeve body 13, and regionally connected to sleeve-shaped section 31 of rigid sleeve body 13. Between disk-shaped section 30 and sleeve-shaped section 31, rigid sleeve body 13 has an edge 34. In this particular exemplary embodiment, damping element 14 is also provided in the region of edge 34. Damping element 14 has an edge section 35 at edge 34. During the production the material for configuring damping element 14 may be extruded onto rigid body 13, for example. This causes edge section 35 of damping element 14 to come to rest against edge 34 without a gap.

In the assembled state, disk-shaped section 32 of damping element 14 absorbs axial movements of holder body 9, as indicated by double arrow 36. Sleeve-shaped section 33 of damping element 14, on the other hand, absorbs radial movements of holder body 9, as indicated by double arrow 37. The integral connection between damping element 14 and rigid sleeve body 13 prevents relative movements between damping element 14 and rigid sleeve body 13.

Figure 3:
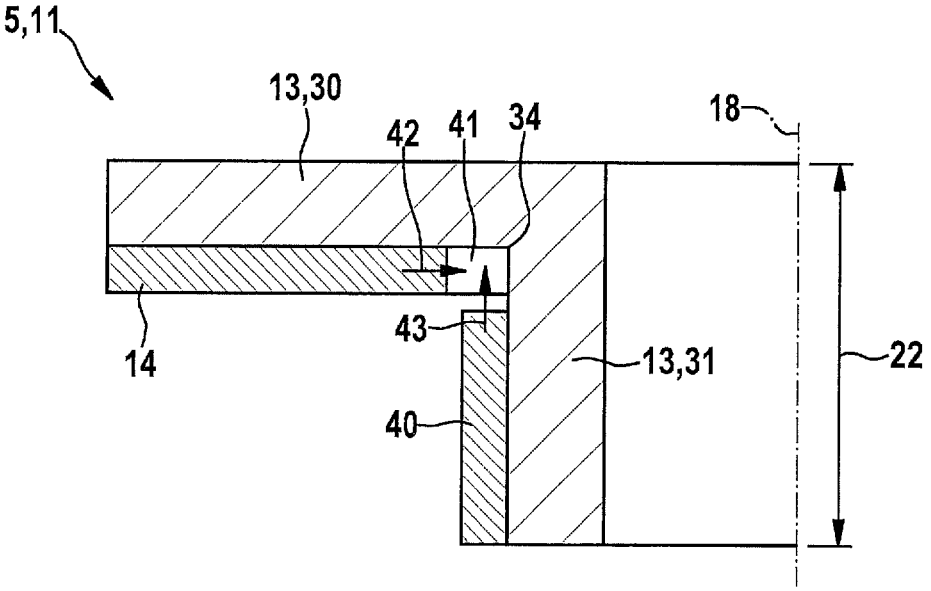
FIG. 3 shows the detail of the sleeve part of the bearing sleeve shown in FIG. 2 according to a second exemplary embodiment of the present invention.

FIG. 3 shows sleeve part 11 of bearing sleeve 5 illustrated in a cutaway view in FIG. 2 according to a second exemplary embodiment. In this exemplary embodiment, damping element 14 is connected to disk-shaped section 30 of rigid sleeve body 13. In addition, a second damping element 40 is provided, which is connected to sleeve-shaped section 31 of rigid sleeve body 13. Damping element 14 is configured as disk-shaped damping element 14 in this exemplary embodiment. Second damping element 40 is configured as sleeve-shaped damping element 40. In this particular exemplary embodiment, a free space 41 with respect to abutting damping elements 14, 40 is provided in the region of edge 34 of rigid sleeve body 13. This allows damping elements 14, 40 to expand into free space 41 in response to vibrations of holder body 9, as indicated by arrows 42, 43. High dynamic rigidness, which impairs the isolating effect in a complete chambering, is thereby avoided. Layer-shaped damping elements 14, 40 are able to breathe in the direction of arrows 42, 43, so to speak. The configuration using multiple damping elements 14, 40 enlarges the free surface in the sum. The vibration damping is thus able to be improved with respect to the particular application.

Figure 4:
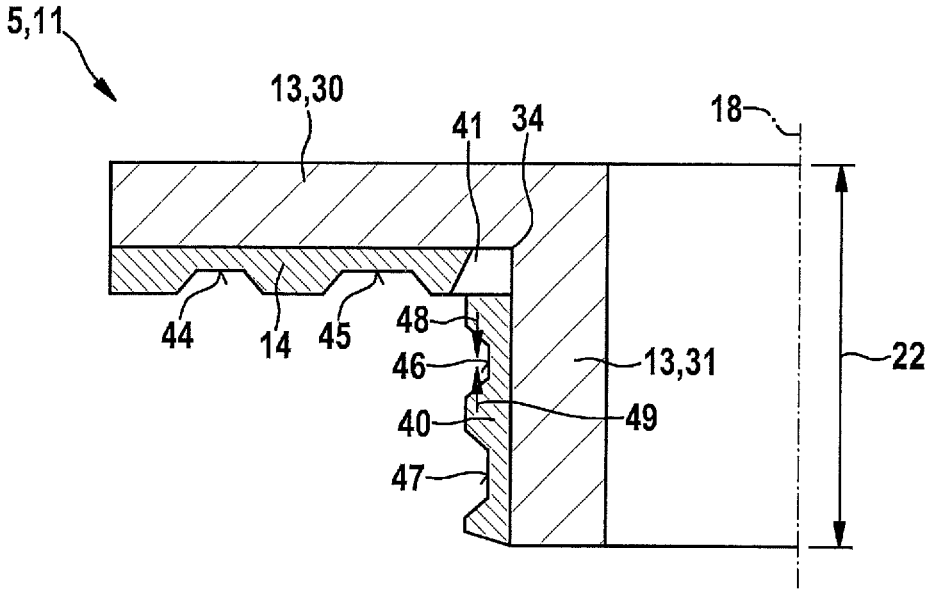
FIG. 4 shows the sleeve part, shown in a detail view in FIG. 2, of the bearing sleeve according to a third exemplary embodiment of the present invention.

FIG. 4 shows sleeve part 11 of bearing sleeve 5, shown as a cutaway view in FIG. 2, according to a third exemplary embodiment. In this exemplary embodiment, damping element 14 is connected to disk-shaped section 30 of rigid sleeve body 13. Second damping element 40 is connected to sleeve-shaped section 31 of rigid sleeve body 13. A free space 41 is provided between damping elements 14, 40 at edge 34. In addition, damping element 14 has depressions 44, 45. Profiling of damping element 14 is achieved with the aid of depressions 44, 45. In analogous manner, second damping element 40 has depressions 46, 47 as well. If second damping element 40 is acted upon as a result of vibrations of holder body 9, for example, then the elastically deformable material of second damping element 40 may breathe in the direction of arrows 48, 49, among others, or escape into depression 46. The same applies to depression 47. This improves the elastic deformability of second damping element 40. The behavior of damping element 14 is optimized accordingly.

A holding force on holder body 9 is also able to be enhanced, especially with the aid of depressions 44, 45 of damping element 14.

Figure 5:
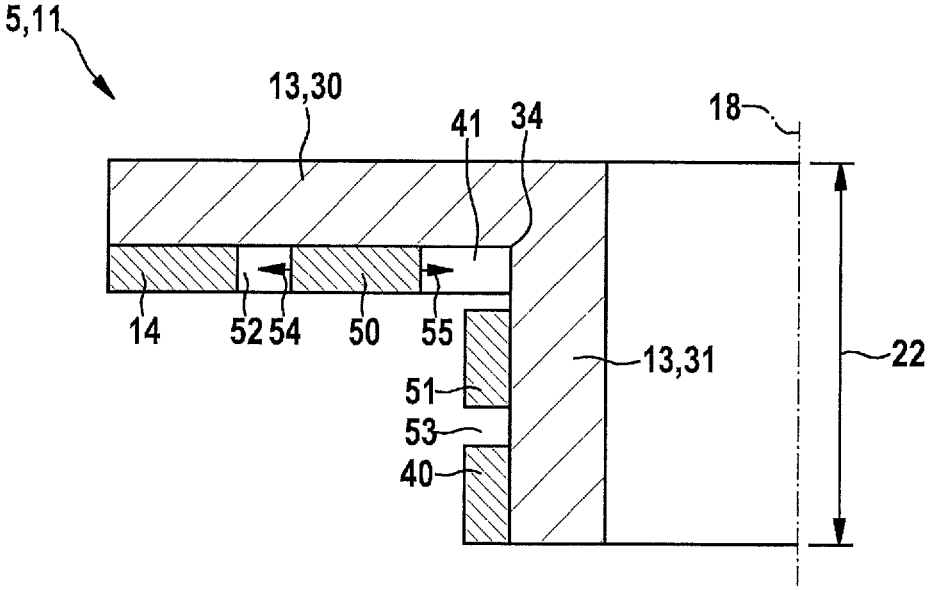
FIG. 5 shows the sleeve part, shown in a detail view in FIG. 2, of the bearing sleeve according to a fourth exemplary embodiment of the present invention.

FIG. 5 shows sleeve part 11 of bearing sleeve 5, shown in a cutaway view in FIG. 2, according to a fourth exemplary embodiment. In this exemplary embodiment, damping element 14 is connected to disk-shaped section 30 of rigid sleeve body 13. Furthermore, a further damping element 50 is provided, which is connected to disk-shaped section 30 of rigid sleeve body 13. In addition, damping element 40 is connected to sleeve-shaped section 31 of rigid sleeve body 13. Moreover, a further damping element 51 is situated at sleeve-shaped section 31 of rigid sleeve body 13, which may be connected to rigid sleeve body 13 by vulcanization. As a result, damping elements 14, 50 are integrally connected to disk-shaped section 30 of rigid sleeve body 13, and damping elements 40, 51 are integrally connected to sleeve-shaped section 31 of rigid sleeve body 13. An annular free space 52 is provided between damping elements 14, 50. Furthermore, free space 41 is provided between damping elements 50, 51 in the region of edge 34 of rigid sleeve body 13. In addition, a free space 53 is available between damping elements 40, 51.

Damping elements 14, 40, 50, 51 may be configured in the form of a ring. Because of free spaces 41, 52, 53, damping elements 14, 40, 50, 51 are better able to deform due to the additional degrees of freedom. For example, further damping element 50 is able to breathe in the direction of arrows 54, 55.

The profiling and subdividing may also be implemented in the axial direction and not necessarily in the form of a circle. Possible is also a configuration in the form of a nub-type profiling.

The present invention is not limited to the exemplary embodiments described.

What is claimed is:

1. A bearing sleeve for a holder used for fastening a component, which is a fuel distributor, on an add-on structure, comprising:

a first sleeve part including (1) a first rigid sleeve body, (2) a first damping element integrally connected to the first sleeve body, and (3) a first additional damping element integrally connected to the first sleeve body and completely separated from the first damping element by a free space, wherein the first damping element and the first additional damping element are vulcanized onto the first rigid sleeve body; and a second sleeve part including (1) a second rigid sleeve body, (2) a second damping element integrally connected to the second sleeve body, and (3) a second additional damping element integrally connected to the second sleeve body and completely separated from the second damping element by a free space, wherein the second damping element and the second additional damping element are vulcanized onto the second rigid sleeve body.

2. The bearing sleeve of claim 1, wherein the rigid sleeve body of the first sleeve part is at least essentially made from a metallic material, and/or the rigid sleeve body of the second sleeve part is at least essentially made from a metallic material.

3. The bearing sleeve of claim 1, wherein the damping element of the first sleeve part is made of rubber, especially natural rubber or a synthetic rubber material, and/or the damping element of the second sleeve part is made of rubber, including at least one of a natural rubber and a synthetic rubber material.

4. The bearing sleeve of claim 1, wherein the rigid sleeve body of the first sleeve part has a disk-shaped section, which is oriented at least approximately perpendicularly to a longitudinal axis, and a sleeve-shaped section, which extends at least approximately along the longitudinal axis.

5. The bearing sleeve of claim 4, wherein the first damping element is vulcanized onto the disk-shaped section of the first rigid sleeve body, and the first additional damping element is vulcanized onto the sleeve-shaped section of the first rigid sleeve body.

6. The bearing sleeve of claim 4, wherein the damping element of the first sleeve part is regionally connected to the disk-shaped section of the rigid sleeve body of the first sleeve part, and regionally to the sleeve-shaped section of the rigid sleeve body of the first sleeve part.

7. The bearing sleeve of claim 4, wherein the damping element of the first sleeve part is connected to the disk-shaped section of the rigid sleeve body of the first sleeve part, and the first sleeve part has at least one second damping element, which is connected to the sleeve-shaped section of the rigid sleeve body of the first sleeve part.

8. The bearing sleeve of claim 4, wherein at least one additional damping element of the first sleeve part is connected to the disk-shaped section of the rigid sleeve body of the first sleeve part, and/or at least one further damping element of the first sleeve part is connected to the sleeve-shaped section of the rigid sleeve body of the first sleeve part.

9. The bearing sleeve of claim 1, wherein depressions are formed on at least one damping element.

10. The bearing sleeve of claim 1, wherein the first sleeve part and the second sleeve part are configured as components in common, and/or the rigid sleeve body of the first sleeve part and the rigid sleeve body of the second sleeve part are configured as components in common.

11. The bearing sleeve of claim 1, wherein the rigid sleeve body of the second sleeve part is configured as disk-shaped rigid sleeve body having a central opening.

12. The bearing sleeve of claim 1, wherein the component is a fuel distributor.

13. The bearing sleeve of claim 1, wherein the first sleeve part and second sleeve part are configured to be fastened to opposite sides of the component, relative to one another.

14. The bearing sleeve of claim 13, wherein the first sleeve part and second sleeve part are configured to be fastened on the opposite sides of the component, and to the add-on structure via a screw.

15. The bearing sleeve of claim 14, wherein when fastened to the component and the add-on structure, the rigid sleeve body of the first sleeve part touches the rigid sleeve body of the second sleeve part.

16. A holder for fastening a component on an add-on structure, comprising:

a holder body; and at least one bearing sleeve, including a first sleeve part and a second sleeve part, wherein the first sleeve part has (1) a first rigid sleeve body, (2) a first damping element integrally connected to the first sleeve body, and (3) a first additional damping element integrally connected to the first sleeve body and completely separated from the first damping element by a free space, wherein the first damping element being vulcanized onto the first rigid sleeve body, wherein the second sleeve part has (1) a second rigid sleeve body, (2) a second damping element integrally connected to the second sleeve body, and (3) a second additional damping element integrally connected to the second sleeve body and completely separated from the second damping element by a free space, wherein the second damping element and the second additional damping element are vulcanized onto the second rigid sleeve body, and wherein the holder body is at least regionally clamped between at least one damping element of the first sleeve part and at least one damping element of the second sleeve part, so as to connect the holder body to the bearing sleeve.

17. The holder of claim 16, wherein the component is a fuel distributor and the add-on structure is an internal combustion engine.

18. The fuel injection system of claim 16, wherein the first rigid sleeve body of the first sleeve part has a disk-shaped section, which is oriented at least approximately perpendicularly to a longitudinal axis, and a sleeve-shaped section, which extends at least approximately along the longitudinal axis.

19. The fuel injection system of claim 18, wherein the first damping element is vulcanized onto the disk-shaped section of the first rigid sleeve body, and the first additional damping element is vulcanized onto the sleeve-shaped section of the first rigid sleeve body.

20. A fuel-injection system, comprising:

a fuel distributor; and at least one holder, for fastening the fuel distributor on an internal combustion engine, including:

a holder body; and at least one bearing sleeve, including a first sleeve part and a second sleeve part, the second sleeve part, wherein the first sleeve part has (1) a first rigid sleeve body, (2) a first damping element integrally connected to the first sleeve body, and (3) a first additional damping element integrally connected to the first sleeve body and completely separated from the first damping element by a free space, wherein the first damping element being vulcanized onto the first rigid sleeve body, wherein the second sleeve part has (1) a second rigid sleeve body, (2) a second damping element integrally connected to the second sleeve body, and (3) a second additional damping element integrally connected to the second sleeve body and completely separated from the second damping element by a free space, wherein the second damping element and the second additional damping element are vulcanized onto the second rigid sleeve body, and wherein the holder body is at least regionally clamped between at least one damping element of the first sleeve part and at least one damping element of the second sleeve part, so as to connect the holder body to the bearing sleeve.

21. The fuel injection system of claim 20, wherein the first rigid sleeve body of the first sleeve part has a disk-shaped section, which is oriented at least approximately perpendicularly to a longitudinal axis, and a sleeve-shaped section, which extends at least approximately along the longitudinal axis.

22. The fuel injection system of claim 21, wherein the first damping element is vulcanized onto the disk-shaped section of the first rigid sleeve body, and the first additional damping element is vulcanized onto the sleeve-shaped section of the first rigid sleeve body.

* * * * *